United States Patent [19]

Küpper

[11] Patent Number: 4,465,237

[45] Date of Patent: Aug. 14, 1984

[54] INJECTION SYSTEM FOR INJECTING TWO FUELS THROUGH ONE INJECTION NOZZLE

[75] Inventor: Heinz Küpper, Troisdorf-Sieglar, Fed. Rep. of Germany

[73] Assignee: Klöckner-Humboldt-Deutz A.G., Cologne, Fed. Rep. of Germany

[21] Appl. No.: 374,911

[22] Filed: May 4, 1982

[30] Foreign Application Priority Data

May 6, 1981 [DE] Fed. Rep. of Germany ..... 3117796

[51] Int. Cl.[3] ..... F02M 43/00

[52] U.S. Cl. ..... 239/533.3

[58] Field of Search ..... 239/413, 533.3, 533.12

[56] References Cited

U.S. PATENT DOCUMENTS 2,602,703 7/1952 Camner ..... 239/533.11

FOREIGN PATENT DOCUMENTS 2924128 12/1980 Fed. Rep. of Germany .

120609 of 1918 United Kingdom ..... 239/533.4

*Primary Examiner*—John J. Love

*Assistant Examiner*—James R. Moon, Jr.

*Attorney, Agent, or Firm*—Becker & Becker, Inc.

[57] ABSTRACT

An injection nozzle for injecting two different fuels sequentially into the combustion chamber of an internal combustion engine, for instance ignition fuel and main fuel, is proposed. A relief valve is arranged in the main fuel line, and this relief valve creates a relief space between two injection operations. This relief volume is then filled by the ignition fuel. The relief valve essentially includes a spring-loaded piston which is installed in the main fuel line.

4 Claims, 1 Drawing Figure

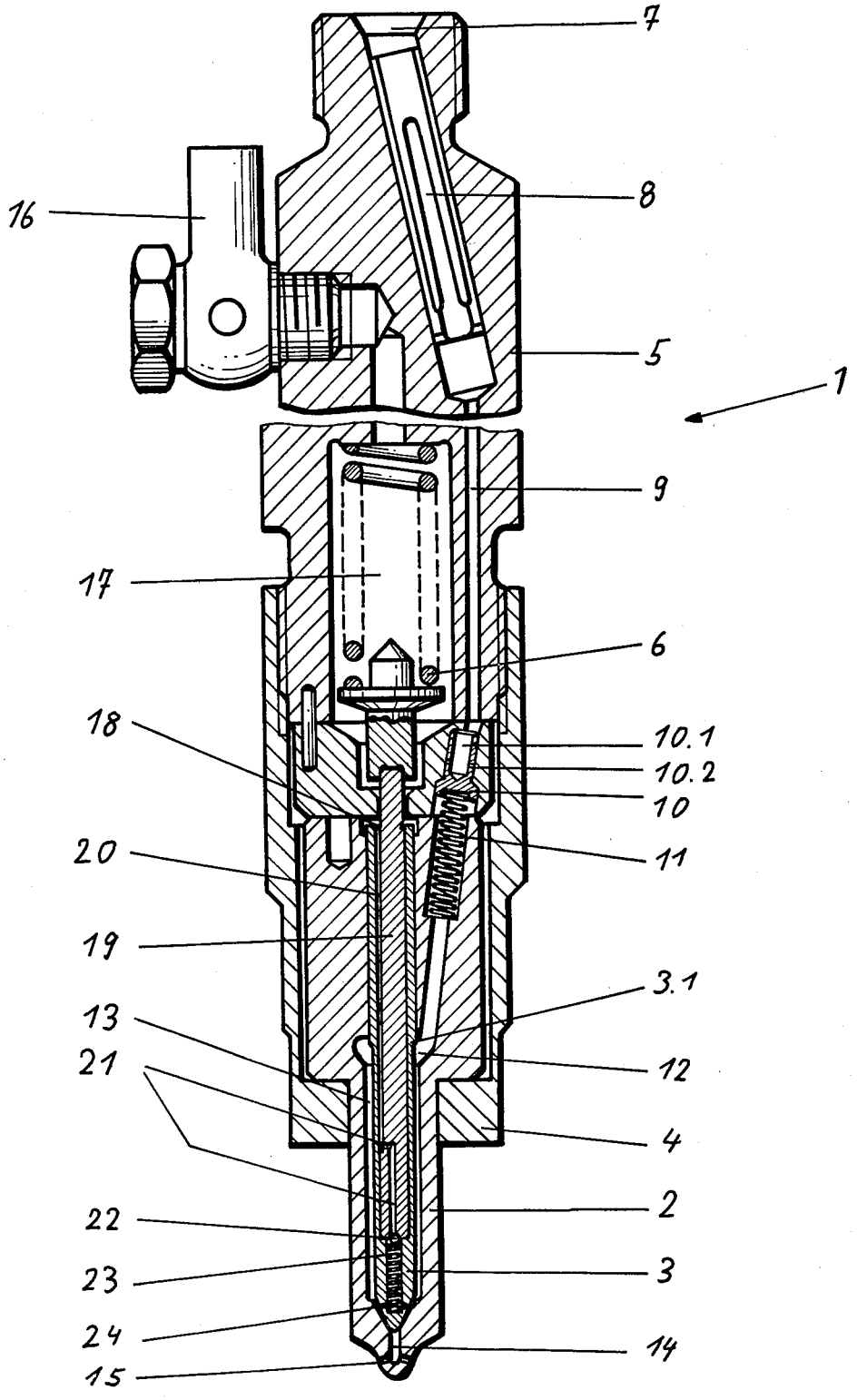
7
8
16
5
1
9
17
6
18
10.1
10.2
10
20
11
19
3.1
13
12
21
4
2
22
23
3
24
14
15

INJECTION SYSTEM FOR INJECTING TWO FUELS THROUGH ONE INJECTION NOZZLE

The present invention relates to an injection system for injecting two fuels by means of one injection nozzle to which both fuels are supplied separately and first encounter each other or meet in the region of the tip of a nozzle needle. The main fuel supply is relieved of pressure via a relief valve, preferably located in the injection pump; a spring-loaded piston is provided inside the injection nozzle and communicates with the main fuel supply line.

German Offenlegungsschrift 29 24 128 discloses an injection nozzle for injecting ignition fuel on the one hand, and a main fuel unwilling to ignite on the other hand, for Diesel engines. This injection nozzle has a separate supply for the main fuel and for the ignition fuel to the seat of the nozzle needle. The ignition fuel is deposited on one side, and the main fuel is deposited on the other side of the nozzle needle above the seat. In order that the ignition fuel enters the combustion chamber ahead of the main fuel, a spring-loaded first-spray or primer piston with differential piston means is provided in the ignition fuel channel; this primer piston, on its single-loaded side, communicates with the main fuel channel via a cross or tie line. The ignition fuel is supplied to that side located opposite the spring-loaded piston side; thus, the piston must be shifted or displaced by the ignition fuel against the pressure of the spring so that the necessary quantity of ignition fuel can be supplied. If then the main fuel is supplied, it acts via the cross line on the spring-loaded side of the primer piston and increases the pressure, because of the differential piston, in such a manner that the nozzle needle is lifted, so that the ignition fuel is injected into the combustion chamber. Thereupon, the pressure of the ignition fuel subsides, the nozzle needle closes again, and only after building up a sufficient pressure in the main fuel line does the nozzle needle open again, allowing the main fuel to enter the combustion chamber.

The disadvantage of this arrangement is that the ignition fuel must be supplied at a relatively high pressure of 20 to 50 bar, since the primer or pre-injection piston must be shifted by the ignition fuel against the spring force. Moreover, a differential piston must be connected after the primer piston so that the initially relatively low pressure of the main fuel can be transferred to the ignition fuel increased in such a manner that the ignition fuel can open the nozzle needle, since it is necessary that the ignition fuel always be injected ahead of the main fuel.

It is an object of the present invention to provide an injection system of the foregoing general type which assures that a sufficient quantity of ignition fuel can be collected for later use at the nozzle needle so that when the needle is opened, this ignition fuel quantity discharges or emerges first.

This object, and other objects and advantages of the present invention, will appear more clearly from the following specification in connection with the accompanying drawing, which is a cross section through a preferred embodiment of the inventive injection nozzle.

The injection nozzle of the present invention is characterized primarily in that the single-loaded piston is a pressure-relief valve which is installed in the main fuel line and closes the same in the pressureless condition of the main fuel line; the piston, as a result of the resilience of the spring, creates a relief volume or space between the valve and the seat of the nozzle needle.

The advantage of this arrangement is that at the moment at which the pressure subsides in the main fuel line, a relief space is created in the injection valve for the ignition fuel, so that the ignition fuel can be supplied at a relatively low pressure of 2 to 4 bar, nevertheless is deposited in the region of the nozzle needle, so that during a single opening movement of the nozzle needle, this ignition fuel discharges first. Consequently, it is not necessary that a pre-injection or primer piston with differential piston be provided which is loaded by the main fuel, so that the nozzle needle is opened once by the ignition fuel and then by the main fuel. According to the present invention, the supplying of the main fuel and the opening of the nozzle needle by the pressure of the main fuel is sufficient to inject the ignition fuel first and to only then inject the main fuel, all in a single injection procedure.

According to a further feature of the present invention, if the main fuel line is separated from the ignition fuel line by a shut-off element arranged in the ignition fuel line in the immediate vicinity of the discharge or outlet opening thereof, the main fuel is prevented from penetrating into the ignition fuel system. The arrangement in the immediate vicinity of the outlet or discharge opening brings about an extremely small dead volume between the valve and the discharge opening. As a result, little mixing of the two fuels is realized during the injection phase.

According to a preferred embodiment, the shut-off element may be a spring-loaded ball check valve, the ball of which may have a diameter of approximately 0.5 to 1 mm. In this way, the smallest possible dimensions are attained, which has the advantage that at the start of the injection operation, a quick closing and a slight leakage are achieved.

According to another embodiment of the present invention, whereby the igniting fuel line extends within the injection nozzle in the nozzle needle, the ignition fuel line may be constructed within the nozzle needle as a throttle gap, with a cylindrical insert having a flat wall being inserted in a blind-hole bore in such a manner that a gap results which is connected via a bore arranged in the insert and the nozzle needle with the outlet or discharge opening from the nozzle needle. As a result of this embodiment, only small quantities of ignition fuel are contained in the nozzle needle, which in no way affect the movement of the nozzle needle.

Referring now to the drawing in detail, the injection nozzle 1 comprises a nozzle body 2, in which a nozzle needle 3 is centrally arranged. The nozzle needle 3 is held in the closed position by the force of the pressure or compression spring 6. The nozzle body 2 is fastened on the nozzle holder 5 by a screw cap or clamping or retaining nut 4.

The main fuel is fed or supplied into the nozzle holder 5 at 7. The main fuel passes through a filtered cartridge 8 into a supply or inlet bore 9, which is closable by a piston 10 that is loaded or biased by a spring 11. The piston 10 and the spring 11 form a relief valve. For this purpose, the piston 10 has a blind hole or blind-end bore 10.1 which is provided with outlets or discharge openings 10.2 that are closed in the position illustrated. The distance of the discharge openings 10.2 from the seat of the piston 10 is a measure for the magnitude of the relief volume. The greater this distance is, the greater the relief volume is. After passing the piston 10, the main fuel arrives in the pressure chamber 12, which is arranged concentrically around the nozzle needle 3. The nozzle needle 3 has a pressure shoulder 3.1 inside the pressure chamber 12, so that the nozzle needle 3 can be lifted against the force of the pressure spring 6 at a suitable pressure of the main fuel. An annular channel 13 extends from the pressure chamber 12 to the seat of the nozzle needle. This annular channel 13 is closed by the nozzle needle when the latter is in the closed state. When the annular channel 13 is open, it merges into an intermediate bore 14, from which one or more orifices or spray holes 15 branchoff.

The ignition fuel is preferably supplied, according to the present invention, through the leakage system provided for conventional injection nozzles. For this purpose, the ignition fuel passes via its connecting line 16 and bores in the nozzle holder 5 to the compression spring chamber 17, and from there to the nozzle needle 3. In order to convey the ignition fuel to the interior of the nozzle needle 3 to just above the needle seat, the nozzle needle has a blind hole or blind-end bore 18 into which a cylindrical insert 19 with a flat side wall is inserted. A gap 20 is thereby formed between the flat side wall and the inner wall of the nozzle needle. This gap 20, in the lower region of the nozzle needle, is connected with a central bore 21 in the insert 19 and the nozzle needle 3. Several outlets or discharge openings 24 to the annular channel 13 are provided from that end of the nozzle needle 3 just above the nozzle needle seat. A ball 22 and a spring 23, which together form a check valve, are arranged in the bore 21 and close the same.

The device according to the present invention operates in the following manner.

Between two injection operations, the injection valve 1 is in the illustrated position, i.e., the nozzle needle 3 is closed and the piston 10 is located in the illustrated position. The piston 10 can assume this position because a pressure-relief valve is provided in the main fuel system, so that the pressure in the supply or inlet bore 9 decreases after termination of an injection operation, so that the spring 11 can shift the piston 10 into the illustrated position.

Since the ignition fuel is to be injected first during each injection operation, it must also be supplied first. To accomplish this, the ignition fuel is delivered by a constant feed fuel pump at a pressure of 3 to 4 bar via the connecting line 16 to the pressure spring chamber 17, into the gap 20, and from there via the central bore 21 to the check valve. The spring 23 of the check valve is set or adjusted in such a way that the check valve opens at a pressure of 2 bar. Consequently, the ignition fuel flows via the discharge openings 24 into the annular channel 13.

The main fuel remaining in the annular channel 13 from the last injection operation exists pressureless since, as a result of the closing movement of the piston 10, which is constructed as a relief valve, the space existing between the piston 10 and the nozzle needle seat is enlarged by the closing movement of the piston 10, for instance by 10 to 15 $mm^3$. The ignition fuel thereby easily moves into the annular channel 13, and can collect around the tip of the nozzle needle.

The main fuel is subsequently supplied under pressure. The force of the spring 11 of the relief valve is dimensioned in such a way that the main fuel can shift or displace the piston 10, so that the main fuel can flow via the outlets or discharge openings 10.2 to the pressure chamber 12, and from there into the annular channel 13. Because of the pressure of the main fuel, the nozzle needle is lifted by means of the pressure shoulder 3.1. Consequently, the ignition fuel previously collected at the nozzle needle seat can, via the intermediate bore 14 and the spray holes or orifices 15, enter into the combustion chamber, followed by the main fuel.

When the feeding of the main fuel is terminated, and the pressure in the main fuel line subsides, both the nozzle needle 3 and the piston 10 again close. The relief space is thereby again formed in the main fuel channel between the piston 10 and the nozzle needle seat, so that the ignition fuel can be supplied.

Because of the check valve in the ignition fuel line, there is prevented during the injection operation that the main fuel penetrates into the ignition fuel line, so that during supplying of ignition fuel the main fuel must first be pressed out again. Since this main fuel would then occupy the relief space created in the annular channel 13, too little ignition fuel could be collected for later use. For this reason, the check valve is arranged as close as possible to the discharge openings 24, and has a mass which is small enough that the check valve can react without lagging, i.e., in an inertialess manner.

The present invention is, of course, in no way restricted to the specific disclosure of the specification and drawing, but also encompasses any modifications within the scope of the appended claims.

What I claim is:

1. An injection nozzle for injecting two fuels, namely a main fuel and an ignition fuel, by means of a single injection nozzle, into the combustion chamber of an internal combustion engine, said injection nozzle comprising:

a nozzle body;

a nozzle needle displaceably arranged in said nozzle body, said nozzle body being provided with a seat for the tip of said nozzle needle;

a main fuel line structurally in communication with a supply of main fuel and being adapted to be relieved of pressure;

an ignition fuel line structurally in communication with a supply of ignition fuel, both of said fuel lines supplying fuel separately to said injection nozzle, with fuel from said fuel lines first encountering each other within said nozzle body of said single injection nozzle in the region of the tip of said nozzle needle; and a pressure-relief valve provided in said injection nozzle and installed in said main fuel line therewith for closing said main fuel line when the latter is in a pressureless state, said pressure-relief valve including a piston, and a spring for loading said piston, said piston, as a result of the resilience of said spring, being adapted to create a relief space between said pressure-relief valve and said seat of said nozzle needle, said nozzle needle being provided with at least one discharge opening in its tip region near said needle seat for establishing communication between said ignition fuel line and said main fuel line structurally operatively associated therewith; and which includes a shut-off element in said ignition fuel line, in the immediate vicinity of said at least one discharge opening, for selectively effecting and preventing said communication between said ignition fuel line and said main fuel line.

2. An injection nozzle according to claim 1, in which said shut-off element is a check valve comprising a ball, and a spring for loading said ball.

3. An injection nozzle according to claim 2, in which said ball has a diameter of approximately 0.5 to 1 mm.

4. An injection nozzle according to claim 1, in which said ignition fuel line extends within said injection nozzle and said nozzle needle as a throttle gap; in which said nozzle needle has a blind hole bore at that end opposite its tip; in which a cylindrical insert having a flat wall is inserted in said blind hole bore in such a way that said gap results between said flat wall and the inner wall of said nozzle needle resulting from said blind hole bore; in which said cylindrical insert is provided with a bore which communicates with said gap; and in which said nozzle needle is provided with a bore which communicates with said bore of said cylindrical insert, and, via said shut-off element, with said at least one discharge opening in said nozzle needle.

* * * * *